US010728679B2

(12) United States Patent
Ozden

(10) Patent No.: US 10,728,679 B2
(45) **Date of Patent: *Jul. 28, 2020**

(54) ANTENNA SYSTEM FOR A HEARING AID

(71) Applicant: GN HEARING A/S, Ballerup (DK)

(72) Inventor: Sinasi Ozden, Soborg (DK)

(73) Assignee: GN HEARING A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/392,606

(22) Filed: Apr. 23, 2019

(65) Prior Publication Data

US 2019/0320270 A1 Oct. 17, 2019

Related U.S. Application Data

(63) Continuation of application No. 15/641,133, filed on Jul. 3, 2017, now Pat. No. 10,390,150, which is a (Continued)

(30) Foreign Application Priority Data

| | | |
|---|---|---|
| Oct. 12, 2010 | (DK) | 2010 00931 |
| Apr. 7, 2011 | (DK) | 2011 00272 |
| Jul. 15, 2011 | (DK) | 2011 70392 |

(51) Int. Cl.
*H04R 25/00* (2006.01)
*H01Q 1/27* (2006.01)

(Continued)

(52) U.S. Cl.
CPC ..... *H04R 25/554* (2013.01); *H01Q 1/245* (2013.01); *H01Q 1/273* (2013.01); *H01Q 1/36* (2013.01);

(Continued)

(58) Field of Classification Search
CPC ..... H04R 2225/51; H01Q 1/273
See application file for complete search history.

(56) References Cited

U.S. PATENT DOCUMENTS

| | | | |
|---|---|---|---|
| 2,535,063 | A | 12/1950 | Halstead |
| 3,276,028 | A | 9/1966 | Mayes et al. |

(Continued)

FOREIGN PATENT DOCUMENTS

| | | | |
|---|---|---|---|
| CN | 1684549 | A | 10/2005 |
| CN | 101835082 | A | 9/2010 |

(Continued)

OTHER PUBLICATIONS

1st Technical Examination and Search Report dated Jan. 24, 2013 for DK Patent Application No. PA 2012 70411, 5 pages.

(Continued)

*Primary Examiner* — Fan S Tsang
*Assistant Examiner* — Ryan Robinson
(74) *Attorney, Agent, or Firm* — Vista IP Law Group, LLP

(57) ABSTRACT

A hearing aid includes: a hearing aid assembly having an antenna for emission of an electromagnetic field, a transceiver for wireless data communication, the transceiver interconnected with the antenna, and a housing for accommodation of the antenna; wherein the antenna comprises a first section having a length between at least one sixteenth wavelength and a full wavelength of the electromagnetic field, the antenna being positioned so that current flows in the first section in a direction that corresponds with an ear-to-ear axis of a user when the housing is worn in its operational position by the user, whereby the electromagnetic field emitted by the antenna propagates along a surface of a head of the user with its electrical field substantially orthogonal to the surface of the head of the user.

27 Claims, 8 Drawing Sheets

Related U.S. Application Data continuation of application No. 13/271,180, filed on Oct. 11, 2011, now Pat. No. 9,729,979.

(51) Int. Cl.
*H01Q 1/36* (2006.01)
*H01Q 9/42* (2006.01)
*H01Q 1/24* (2006.01)

(52) U.S. Cl.
CPC ..... *H01Q 9/42* (2013.01); *H04R 25/552* (2013.01); *H04R 25/558* (2013.01); *H04R 2225/021* (2013.01); *H04R 2225/51* (2013.01)

(56) References Cited

U.S. PATENT DOCUMENTS 4,334,315 A 6/1982 Ono et al.
4,652,888 A 3/1987 Deasy
4,741,339 A 5/1988 Harrison et al.
4,924,237 A 5/1990 Honda et al.
5,426,719 A 6/1995 Franks
5,621,422 A 4/1997 Wang
5,721,783 A * 2/1998 Anderson ..... H04B 1/385 381/312
5,760,746 A 6/1998 Kawahata
5,761,319 A 6/1998 Dar et al.
6,161,036 A 12/2000 Matsumura
6,456,720 B1 9/2002 Brimnall
6,515,629 B1 2/2003 Kuo et al.
6,748,094 B1 6/2004 Tziviskos et al.
6,766,201 B2 7/2004 Von Arx et al.
6,911,944 B2 6/2005 Sekine
6,924,773 B1 8/2005 Paratte
7,002,521 B2 2/2006 Egawa et al.
7,020,298 B1 3/2006 Tziviskos et al.
7,046,499 B1 5/2006 Imani
7,154,442 B2 12/2006 Van Wonterghem et al.
7,256,747 B2 8/2007 Victorian et al.
7,446,708 B1 11/2008 Nguyen et al.
7,450,078 B2 * 11/2008 Knudsen ..... H01Q 1/273 343/702
7,570,777 B1 8/2009 Taenzer et al.
7,593,538 B2 9/2009 Polinske
7,630,772 B1 12/2009 Walsh
7,652,628 B2 * 1/2010 Zweers ..... H01Q 1/243 343/702
7,791,551 B2 9/2010 Platz
7,978,141 B2 7/2011 Chi et al.
8,401,211 B2 * 3/2013 Angst ..... H04R 25/556 381/312
8,494,197 B2 * 7/2013 Polinske ..... H01Q 1/243 343/866
8,934,984 B2 1/2015 Meskens et al.
2002/0091337 A1 7/2002 Adams
2003/0098812 A1 5/2003 Ying
2004/0073275 A1 4/2004 Maltan et al.
2004/0080457 A1 4/2004 Guo et al.
2004/0138723 A1 7/2004 Malick et al.
2004/0246179 A1 12/2004 Chen et al.
2005/0068234 A1 3/2005 Hung et al.
2005/0094840 A1 5/2005 Harano
2005/0099341 A1 * 5/2005 Zhang ..... H01Q 1/273 343/700 MS
2005/0244024 A1 11/2005 Fischer et al.
2005/0248717 A1 11/2005 Howell et al.
2005/0251225 A1 11/2005 Faltys et al.
2006/0012524 A1 1/2006 Mierke et al.
2006/0018496 A1 1/2006 Niederdrank et al.
2006/0052144 A1 3/2006 Seil et al.
2006/0056649 A1 3/2006 Schumaler
2006/0061512 A1 3/2006 Asano et al.
2006/0064037 A1 3/2006 Shalon
2006/0071869 A1 4/2006 Yoshino et al.
2006/0115103 A1 6/2006 Feng et al.
2006/0181466 A1 8/2006 Krupa
2006/0192723 A1 8/2006 Harada et al.
2007/0080889 A1 * 4/2007 Zhang ..... H01Q 1/273 343/895
2007/0171134 A1 7/2007 Yoshino et al.
2007/0229369 A1 10/2007 Platz
2007/0229376 A1 10/2007 Desclos et al.
2007/0230714 A1 10/2007 Armstrong
2007/0285321 A1 12/2007 Chung et al.
2008/0024375 A1 1/2008 Martin et al.
2008/0056520 A1 3/2008 Christensen et al.
2008/0079645 A1 4/2008 Higasa et al.
2008/0158068 A1 7/2008 Huang
2008/0231524 A1 9/2008 Zeiger et al.
2008/0300658 A1 12/2008 Meskens
2008/0304686 A1 12/2008 Meskens et al.
2009/0074221 A1 3/2009 Westermann
2009/0124201 A1 5/2009 Meskens
2009/0169038 A1 7/2009 Knudsen et al.
2009/0196444 A1 8/2009 Solum
2009/0214064 A1 * 8/2009 Wu ..... H04R 25/554 381/315
2009/0231204 A1 * 9/2009 Shaker ..... H01Q 1/273 343/700 MS
2009/0231211 A1 9/2009 Zweers
2009/0243944 A1 10/2009 Jung et al.
2009/0273530 A1 11/2009 Chi et al.
2009/0315787 A1 12/2009 Schatzle
2010/0020994 A1 1/2010 Christensen et al.
2010/0033380 A1 2/2010 Pascolini et al.
2010/0097275 A1 4/2010 Parsche
2010/0109953 A1 5/2010 Tang
2010/0158291 A1 6/2010 Polinske et al.
2010/0158293 A1 6/2010 Polinske et al.
2010/0158295 A1 6/2010 Polinske et al.
2010/0172525 A1 7/2010 Angst et al.
2010/0245201 A1 9/2010 Hossain et al.
2010/0285851 A1 11/2010 Horihata
2010/0321269 A1 12/2010 Ishibana et al.
2011/0007927 A1 1/2011 Hedrick et al.
2011/0022121 A1 1/2011 Meskins
2011/0129094 A1 6/2011 Petersen
2011/0249836 A1 10/2011 Solum
2011/0285599 A1 11/2011 Smith
2011/0294537 A1 12/2011 Vance
2012/0087506 A1 4/2012 Ozden
2012/0093324 A1 4/2012 Sinasi
2012/0154222 A1 6/2012 Oh et al.
2012/0326938 A1 12/2012 Grossman
2013/0308805 A1 11/2013 Ozden
2013/0342407 A1 12/2013 Kvist
2014/0010392 A1 1/2014 Kvist
2014/0097993 A1 4/2014 Hotta
2014/0185848 A1 7/2014 Ozden et al.
2014/0321685 A1 10/2014 Rabel
2014/0378958 A1 12/2014 Leussler

FOREIGN PATENT DOCUMENTS

CN 102318138 A 1/2012
CN 102570000 A 7/2012
DE 3625891 A1 2/1988
DE 10 2004 017832 10/2005
DE 10 2008 022 127 A1 11/2009
EP 1 231 819 A2 8/2002
EP 1 294 049 A1 3/2003
EP 1 465 457 A2 10/2004
EP 1 465 457 A3 10/2004
EP 1 589 609 10/2005
EP 1 594 188 A1 11/2005
EP 1 681 903 A2 7/2006
EP 1 763 145 A1 3/2007
EP 1 939 984 A1 2/2008
EP 1 953 934 A1 8/2008
EP 2 076 065 A1 1/2009
EP 2 088 804 A1 8/2009
EP 2 200 120 A2 6/2010
EP 2 200 120 A3 6/2010
EP 2 207 238 A1 7/2010

(56) References Cited

FOREIGN PATENT DOCUMENTS

| | | | | |
|---|---|---|---|---|
| EP | 2 229 009 | A1 | 9/2010 | |
| EP | 2 302 737 | | 3/2011 | |
| EP | 2 458 674 | A2 | 5/2012 | |
| EP | 2 637 251 | | 11/2013 | |
| EP | 2 680 366 | | 1/2014 | |
| EP | 2 723 101 | A2 | 4/2014 | |
| EP | 2 723 101 | A3 | 4/2014 | |
| EP | 2 765 650 | | 8/2014 | |
| JP | S59-97204 | | 6/1984 | |
| JP | H10-209739 | | 8/1998 | |
| JP | 2005-304038 | A | 10/2005 | |
| JP | 2006025392 | | 1/2006 | |
| JP | 2006-033853 | A | 2/2006 | |
| JP | 2012-090266 | | 5/2012 | |
| WO | WO 98/44762 | | 10/1998 | |
| WO | WO 03/026342 | | 3/2003 | |
| WO | WO 2004/110099 | A2 | 12/2004 | |
| WO | WO 2005/076407 | A2 | 8/2005 | |
| WO | WO 2005/081583 | A1 | 9/2005 | |
| WO | WO 2005-304038 | A | 10/2005 | |
| WO | WO 2006-033853 | A | 2/2006 | |
| WO | WO 2006/055884 | A2 | 5/2006 | |
| WO | WO 2006122836 | A2 | 11/2006 | |
| WO | WO 2007/045254 | A1 | 4/2007 | |
| WO | WO 2007/140403 | A2 | 6/2007 | |
| WO | WO 2008/012355 | A1 | 1/2008 | |
| WO | WO 2009/010724 | A1 | 1/2009 | |
| WO | WO 2009010724 | A1 * | 1/2009 | ..... H01Q 1/273 |
| WO | WO 2009/098858 | A1 | 8/2009 | |
| WO | WO 2009117778 | A1 | 10/2009 | |
| WO | WO 2010/065356 | A1 | 6/2010 | |
| WO | WO 2011099226 | | 8/2011 | |
| WO | WO 2012059302 | | 5/2012 | |
| WO | WO 2014090420 | A1 | 6/2014 | |

OTHER PUBLICATIONS

1st Technical Examination and Search Report dated Jan. 25, 2013 for DK Patent Application No. PA 2012 70412, 4 pages.
Advisory Action dated Aug. 29, 2014 for U.S. Appl. No. 13/740,471.
Chinese Office Action and Search Report dated Dec. 4, 2013 for related CN Patent Application No. 201110317229.4.
Chinese Office Action and Search Report dated Nov. 12, 2013 for related CN Patent Application No. 201110317264.6.
Danish Office Action dated Apr. 30, 2012 for Danish Patent Application No. PA 2011 70566.
Danish Office Action dated May 1, 2012 for Danish Patent Application No. PA 2011 70567.
English Abstract of Foreign Reference DE 10 2008 022 127 A1 (included in 1st page of Foreign Patent Ref. No. 3).
Extended European Search Report dated Apr. 17, 2014 for EP Patent Application No. 13192316.1.
Extended European Search Report dated Apr. 22, 2014 for EP Patent Application No. 13192323.7.
Extended European Search Report dated Mar. 7, 2014 for EP Patent Application No. 11184503.8.
Extended European Search Report dated Mar. 7, 2014 for EP Patent Application No. 11184507.9.
Extended European Search Report dated May 6, 2014 for EP Patent Application No. 13175258.6.
Final Office Action dated Aug. 29, 2014 for U.S. Appl. No. 13/848,605.
Final Office Action dated Feb. 27, 2014, for U.S. Appl. No. 13/271,180.
Final Office Action dated May 19, 2014 for U.S. Appl. No. 13/740,471.
First Danish Office Action dated Apr. 26, 2011 for corresponding Danish Patent Application No. PA 2010 00931.
First Office Action dated Feb. 12, 2013 for Japanese Patent Application No. 2011-224711.
First Danish Technical Examination and Search Report dated Jan. 18, 2013 for DK Patent Application No. PA 2012 70410, 4 pages.
Fourth Danish Office Action , Intention to Grant dated Feb. 13, 2013 for corresponding Danish Patent Application No. PA 2010 00931.
Non-final Office Action dated Jan. 2, 2014 for U.S. Appl. No. 13/740,471.
Non-Final Office Action dated Jul. 29, 2014 for U.S. Appl. No. 13/917,448.
Non-Final Office Action dated Mar. 27, 2014 for U.S. Appl. No. 13/848,605.
Non-Final Office Action dated May 22, 2014 for U.S. Appl. No. 13/271,170.
Non-final Office Action dated Oct. 8, 2013 for U.S. Appl. No. 13/271,180.
Notice of Reasons for Rejection dated May 21, 2013 for Japanese Patent Application No. 2011-224705.
Second Danish Office Action dated Apr. 24, 2012 for corresponding Danish Patent Application No. PA 2010 00931.
Second Technical Examination—Intention to Grant dated Jul. 8, 2013 for DK Patent Application No. PA 2012 70412, 2 pages.
Second Technical Examination dated Aug. 6, 2013 for DK Patent Application No. PA 2012 70411, 2 pages.
Second Technical Examination dated Jul. 12, 2013, for DK Patent Application No. PA 2012 70410, 2 pages.
Third Danish Office Action dated Oct. 17, 2012 for corresponding Danish Patent Application No. PA 2010 00931.
Third Technical Examination dated Jan. 31, 2014, for DK Patent Application No. PA 2012 70410, 2 pages.
Office Action dated Jun. 17, 2014 in Japanese Patent Application No. 2013-258396, 3 pages.
First Technical Examination dated Jun. 25, 2014 for DK Patent Application No. PA 2013 70665, 5 pages.
First Technical Examination dated Jun. 26, 2014 for DK Patent Application No. PA 2013 70664, 5 pages.
Extended European Search Report dated May 14, 2014 for EP Patent Application No. 13192322.9.
First Technical Examination and Search Report dated Jun. 26, 2014 for DK Patent Application No. PA 2013 70667, 5 pages.
First Technical Examination and Search Report dated Jun. 27, 2014 for DK Patent Application No. PA 2013 70666.
Non-final Office Action dated Nov. 18, 2014 for U.S. Appl. No. 13/271,180.
Conway et al., Antennas for Over-Body-Surface Communication at 2.45 GHz, Apr. 2009, IEEE Transactions on Antennas and Propagation, vol. 57, No. 4, pp. 844-855.
Non-final Office Action dated Nov. 19, 2014 for U.S. Appl. No. 13/931,556.
Non-final Office Action dated Dec. 18, 2014 for U.S. Appl. No. 13/740,471.
Final Office Action dated Dec. 31, 2014 for U.S. Appl. No. 13/271,170.
Non-final Office Action dated Jan. 5, 2015 for U.S. Appl. No. 13/848,605.
Extended European Search Report dated Oct. 9, 2014 for EP Patent Application No. 14181165.3.
Examiner Bengtsson, Rune, "Novelty Search including a Preliminary Patentability Opinion Report", in reference to P81007295DK02, dated Jul. 28, 2011, 8 pages.
Examiner Bengtsson, Rune, "Novelty Search including a Preliminary Patentability Opinion Report", in reference to P81101358DK01, dated Jul. 28, 2011, 8 pages.
Non-final Office Action dated Jan. 15, 2015 for U.S. Appl. No. 14/199,511.
Non-final Office Action dated Feb. 5, 2015 for U.S. Appl. No. 14/198,396.
Non-final Office Action dated Feb. 24, 2015 for U.S. Appl. No. 14/202,486.
Notice of Allowance dated Mar. 5, 2015 for U.S. Appl. No. 13/917,448.
Notice of Allowance dated Apr. 24, 2015 for U.S. Appl. No. 13/931,556.
First Technical Examination and Search Report dated Mar. 9, 2015, for related Danish Patent Application No. PA 2014 70489.
Non-final Office Action dated May 7, 2015 for U.S. Appl. No. 13/271,180.

(56) References Cited

OTHER PUBLICATIONS

Advisory Action dated May 14, 2015 for U.S. Appl. No. 13/271,170.
Notice of Allowance and Fee(s) Due dated May 22, 2015 for U.S. Appl. No. 13/848,605.
Non-final Office Action dated Jun. 10, 2015 for U.S. Appl. No. 14/199,263.
Notice of Allowance and Fee(s) Due dated Jun. 18, 2015, for U.S. Appl. No. 13/917,448.
Communication pursuant to Article 94(3) EPC dated Mar. 16, 2015, for related European Patent Application No. 11 184 503.8, 12 pages.
Communication pursuant to Article 94(3) EPC dated Mar. 19, 2015, for related European Patent Application No. 11 184 507.9, 12 pages.
Non-final Office Action dated Jul. 1, 2015 for U.S. Appl. No. 14/199,070.
Final Office Action dated Jul. 15, 2015 for related U.S. Appl. No. 13/740,471.
Notice of Allowance and Fees Due dated Aug. 3, 2015 for related U.S. Appl. No. 13/931,556.
Non-final Office Action dated Aug. 17, 2015 for related U.S. Appl. No. 14/198,396.
Non-final Office Action dated Aug. 25, 2015 for related U.S. Appl. No. 14/202,486.
Notice of Allowance and Fee(s) Due dated Sep. 2, 2015 for related U.S. Appl. No. 14/199,511.
Notice of Allowance and Fee(s) Due dated Sep. 3, 2015 for related U.S. Appl. No. 13/848,605.
Notice of Allowance and Fee(s) Due dated Sep. 25, 2015 for related U.S. Appl. No. 13/271,170.
Notice of Allowance and Fee(s) Due dated Nov. 18, 2015 for related U.S. Appl. No. 13/931,556.
Final Office Action dated Nov. 18, 2015 for related U.S. Appl. No. 14/199,263.
Non-final Office Action dated Dec. 2, 2015 for related U.S. Appl. No. 13/271,180.
Notice of Allowance and Fee(s) Due dated Dec. 18, 2015 for related U.S. Appl. No. 13/917,448.
Notification of Reasons for Rejection dated Nov. 24, 2015 for related Japanese Patent Application No. 2014-228343, 8 pages.
Notice of Allowance and Fee(s) Due dated Feb. 16, 2016 for related U.S. Appl. No. 13/740,471.
Advisory Action dated Feb. 1, 2016 for related U.S. Appl. No. 14/199,263.
Notice of Allowance and Fees Due dated Mar. 3, 2016 for related U.S. Appl. No. 13/931,556.
Final Office Action dated Mar. 22, 2016 for related U.S. Appl. No. 14/202,486.
Notice of Allowance and Fee(s) due dated Mar. 23, 2016 for related U.S. Appl. No. 14/198,396.
Final Office Action dated Apr. 4, 2016 for related U.S. Appl. No. 13/271,180.
Final Office Action dated Apr. 15, 2016 for related U.S. Appl. No. 14/199,070.
Notice of Allowance and Fee(s) dated May 25, 2016 for related U.S. Appl. No. 14/199,263.
Notice of Allowance and Fee(s) dated Jun. 17, 2016 for related U.S. Appl. No. 13/917,448.
Non-final Office Action dated Sep. 15, 2011 for related U.S. Appl. No. 12/131,867.
Non-final Office Action dated Feb. 10, 2012 for related U.S. Appl. No. 12/131,867.
Final Office Action dated Aug. 23, 2012 for related U.S. Appl. No. 12/131,867.
Non-Final Office Action dated Mar. 7, 2014 for related U.S. Appl. No. 12/131,867.
Notice of Allowance and Fee(s) due dated Sep. 12, 2014 for related U.S. Appl. No. 12/131,867.
Advisory Action dated Jul. 26, 2016 for related U.S. Appl. No. 13/271,180.
Non-final Office Action dated Sep. 29, 2016 for related U.S. Appl. No. 14/461,983.
Notice of Allowance and Fee(s) due dated Oct. 5, 2016 for related U.S. Appl. No. 13/271,180.
Non-final Office Action dated Oct. 24, 2016 for related U.S. Appl. No. 14/199,070.
Notice of Allowance and Fee(s) due dated Oct. 25, 2016 for related U.S. Appl. No. 14/202,486.
European Communication pursuant to Article 94(3) EPC dated Dec. 20, 2016 for corresponding/related EP Patent Application No. 13192323.7, 4 pages.
Notice of Allowance and Fee(s) Due dated Feb. 16, 2017 for related U.S. Appl. No. 14/202,486.
Notice of Allowance and Fee(s) due dated Apr. 11, 2017 for related U.S. Appl. No. 13/271,180.
Notification of First Office Action dated Jan. 26, 2017 for corresponding/related Chinese Patent Application No. 201310713296.7, 21 pages.
Notification of First Office Action dated Feb. 21, 2017 for corresponding/related Chinese Patent Application No. 201410641926.9, 16 pages.
Notification of First Office Action dated Jan. 16, 2017 for related Chinese Patent Application No. 201410643821.7, 14 pages.
Non-final Office Action dated May 12, 2017 for related U.S. Appl. No. 15/455,081.
Final Office Action dated May 19, 2017 for related U.S. Appl. No. 14/461,983.
Final Office Action dated Jun. 21, 2017 for related U.S. Appl. No. 14/199,070.
Notice of Allowance and Fee(s) due dated Nov. 22, 2017 for related U.S. Appl. No. 15/455,081.
Final Office Action dated Sep. 8, 2017 for related U.S. Appl. No. 15/455,081.
Notice of Allowance and Fee(s) dated Sep. 27, 2017 for related U.S. Appl. No. 14/199,070.
Advisory Action dated Sep. 5, 2017 for related U.S. Appl. No. 14/461,983.
Non-final Office Action dated Apr. 4, 2019 for related U.S. Appl. No. 14/461,983.
Communication pursuant to Article 94(3) EPC dated Jan. 3, 2018, for related European Patent Application No. 14 181 165.3, 8 pages.
Non-Final Office Action dated Apr. 20, 2018 for related U.S. Appl. No. 15/188,780.
Final Office Action dated Sep. 26, 2018 for related U.S. Appl. No. 14/461,983.
Notice of Allowance and Fee(s) dated Oct. 10, 2018 for related U.S. Appl. No. 15/188,780.
Advisory Action dated Feb. 12, 2019 for related related U.S. Appl. No. 14/461,983.
Notice of Allowance and Fee(s) dated Oct. 23, 2019 for related U.S. Appl. No. 14/461,983.
Non-Final Office Action dated Oct. 23, 2019 for related U.S. Appl. No. 16/504,091.
Non Final Office Action dated Jan. 31, 2018 for related U.S. Appl. No. 15/641,133.
Final Office Action dated Oct. 2, 2018 for related U.S. Appl. No. 15/641,133.
Advisory Action dated Feb. 7, 2019 for related U.S. Appl. No. 15/641,133.
Notice of Allowance and Fee(s) dated Mar. 29, 2019 for related U.S. Appl. No. 15/641,133.

* cited by examiner

ANTENNA SYSTEM FOR A HEARING AID

This application is a continuation of U.S. patent application Ser. No. 15/641,133 filed on Jul. 3, 2017, now U.S. Pat. No. 10,390,150, which is a continuation of U.S. patent application Ser. No. 13/271,180, filed on Oct. 11, 2011, now U.S. Pat. No. 9,729,979, which claims priority to and the benefit of Danish Patent Application No. PA 2010 00931, filed on Oct. 12, 2010, Danish Patent Application No. PA 2011 00272, filed on Apr. 7, 2011, and Danish Patent Application No. PA 2011 70392, filed on Jul. 15, 2011. The entire disclosures of all of the above applications are expressly incorporated by reference herein.

RELATED APPLICATION DATA

This application is a continuation of U.S. patent application Ser. No. 15/641,133 filed on Jul. 3, 2017, which is a continuation of U.S. patent application Ser. No. 13/271,180, filed on Oct. 11, 2011, now U.S. Pat. No. 9,729,979, which claims priority to and the benefit of Danish Patent Application No. PA 2010 00931, filed on Oct. 12, 2010, Danish Patent Application No. PA 2011 00272, filed on Apr. 7, 2011, and Danish Patent Application No. PA 2011 70392, filed on Jul. 15, 2011. The entire disclosures of all of the above applications are expressly incorporated by reference herein.

FIELD

The present disclosure relates to an antenna system, such as an antenna system provided in a hearing aid, adapted for wireless data communication.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Conventionally, antennas in hearing aids have been used for receiving radio broadcasts or commands from a remote control. Typically, such antennas are designed to fit in the hearing aid housing without special concern with relation to the obtained directivity of the resulting radiation pattern. For example, behind-the-ear hearing aid housings typically accommodate antennas positioned with their longitudinal direction in parallel to the longitudinal direction of the banana shaped behind-the-ear hearing aid housing. In-the-ear hearing aids have typically been provided with patch antennas positioned on the face plate of the hearing aids as for example disclosed in WO 2005/081583; or wire antennas protruding outside the hearing aid housing in a direction perpendicular to the face plate as for example disclosed in US 2010/20994.

SUMMARY

It is an object to provide an improved wireless communication.

In one aspect, the above-mentioned and other objects are obtained by provision of a hearing aid with a hearing aid assembly comprising a transceiver for wireless data communication interconnected with an antenna for emission and reception of an electromagnetic field. The hearing aid may comprise a housing for accommodation of the antenna. The antenna may comprise a first section having a length being between at least one sixteenth wavelength and a full wavelength of the electromagnetic field and may be positioned so that current flows in the first section in a direction substantially in parallel to an ear to ear axis of the user when the housing is worn in its operational position by the user.

Hereby an electromagnetic field emitted by the antenna propagates along the surface of the head of the user with its electrical field substantially orthogonal to the surface of the head of the user.

The hearing aid assembly typically further comprises a microphone for reception of sound and conversion of the received sound into a corresponding first audio signal, a signal processor for processing the first audio signal into a second audio signal compensating a hearing loss of a user of the hearing aid, and a receiver that is connected to an output of the signal processor for converting the second audio signal into an output sound signal. Preferably, the hearing aid assembly has a first side and a second side interconnected via a supporting element.

In another aspect, an antenna system configured to be worn on a body of a user is provided, the antenna system comprises a transceiver for wireless data communication interconnected with an antenna for emission and reception of an electromagnetic field. The antenna may comprise a first section having a length being between at least one sixteenth wavelength and a full wavelength of the electromagnetic field and may be positioned so that current flows in the first section in a direction substantially orthogonal to the body of a user when the antenna system is worn in its operational position by the user. Hereby, an electromagnetic field emitted by the antenna propagates along the surface of the body of the user with its electrical field substantially orthogonal to the surface of the body of the user.

It is an advantage of providing such an antenna system that interconnection between for example a Body Area Network, BAN, or a wireless body area network, WBAN, such as a wearable wireless body area network, and a body external transceiver may be obtained. The body external transceiver may be a processing unit and may be configured to be connected to an operator, an alarm service, a health care provider, a doctors network, etc., either via the internet or any other intra- or interconnection between a number of computers or processing units, either continuously or upon request from either a user, an operator, a provider, or a system generated trigger.

Preferably, the electromagnetic field emitted by the antenna propagates primarily along the surface of the head or body of the user.

The following description is made with reference to a hearing aid, such as a binaural hearing aid. It is however envisaged that the disclosed features and embodiments may be used in combination with any communication device.

The first section may preferably be structured so that upon excitation the current flows in at least the first section in a direction substantially in parallel to an ear to ear axis of the user when the housing is worn in its operational position by the user.

Upon excitation, a substantial part of the electromagnetic field, such as 60%, such as 80%, emitted by the antenna may propagate along the surface of the head of the user with its electrical field substantially orthogonal to the surface of the head of the user. When the electromagnetic field is diffracted around the head of a user, loses due to the interaction with the surface of the head are minimized. Hereby, a significantly improved reception of the electro-magnetic radiation by either a second hearing aid in a binaural hearing aid system, typically located at the other ear of a user, or by a hearing aid accessory, such as a remote control, a telephone, a television set, a spouse microphone, a hearing aid fitting system, an intermediary component, such as a Bluetooth bridging device, etc., is obtained.

In that the electromagnetic field is diffracted around the head of a user with minimum interaction with the surface of the head, the strength of the electromagnetic field around the head of the user is significantly improved. Thus, the interaction with other antennas and/or transceivers, as provided in either a second hearing aid of a binaural hearing aid system located at the other ear of a user, or as provided in accessories as mentioned above, which typically are located in front of a user, is enhanced. It is a further advantage of providing an electromagnetic field around the head of a user that an omni-directional connectivity to external devices, such as accessories, is provided.

The first section of the antenna may be connected to the transceiver and configured so that the first section conducts current of large amplitude at the desired transmission frequency of the electromagnetic field. Hereby, a major part of the power of the electromagnetic field emitted by the antenna and propagating from the antenna at one ear to either an opposite ear of the user or to an external device, such as an accessory, is contributed by the first section of the antenna. Preferably, the current of the proximity antenna element comprising the first section and the parasitic antenna elements are configured so that the current has a maximum current amplitude at the first section. Preferably, the first section has a first end in proximity to the accessory antenna element excitation point and a second end in proximity to the parasitic antenna element excitation point. The parasitic antenna element may have a free end opposite the parasitic antenna element excitation point and the combined length of the first section and the parasitic antenna element may correspond substantially to a quarter wavelength of the electromagnetic radiation or any odd multiple thereof. It is an advantage that the parasitic antenna element assist to further excite currents that run along the short dimension of the ground plane, such as along the first section to thereby further excite the surface wave of the electromagnetic radiation.

The first section of the antenna may be a first linear section, e.g. such as a rod-shaped section, that is positioned so that the longitudinal direction of the first section is parallel to the ear to ear axis when the housing is worn in its operational position by the user, or in other words perpendicular to, or substantially perpendicular to, the surface of the head or any other body part proximate the operational position of the first section.

The configuration of the first section, which is positioned so that current flows in the first section in a direction in parallel to, or substantially in parallel to, an ear to ear axis of the user makes the antenna suitable for wireless communication between devices located in opposite ears or proximate opposite ears due to advantageous features of the emitted electromagnetic field as further explained below.

Preferably, the antenna comprising the at least first section is accommodated within the hearing aid housing, preferably so that the antenna is positioned inside the hearing aid housing without protruding out of the housing.

It is an advantage that, during operation, the first section of the antenna contributes to an electromagnetic field that travels around the head of the user thereby providing a wireless data communication that is robust and has low loss.

Due to the current component normal to the side of the head or normal to any other body part, the surface wave of the electromagnetic field may be more efficiently excited. Hereby, for example an ear-to-ear path gain may be improved, such as by 10-15 dB, such as by 10-20 dB.

The antenna may emit a substantially TM polarized electromagnetic field for diffraction around the head of a user, i.e. TM polarised with respect to the surface of the head of a user.

The antenna does not, or substantially does not, emit an electromagnetic field in the direction of the current path in the first section, and therefore the antenna does not, or substantially does not, emit an electromagnetic field in the direction of the ear to ear axis of the user when the hearing aid housing is positioned in its operational position at the ear of the user; rather, the antenna emits an electromagnetic field that propagates in a direction parallel to the surface of the head of the user when the hearing aid housing is positioned in its operational position during use, whereby the electric field of the emitted electromagnetic field has a direction that is orthogonal to, or substantially orthogonal to, the surface of the head at least along the side of the head at which the antenna is positioned during operation. In this way, propagation loss in the tissue of the head is reduced as compared to propagation loss of an electromagnetic field with an electric field component that is parallel to the surface of the head. Diffraction around the head makes the electromagnetic field emitted by the antenna propagate from one ear and around the head to the opposite ear.

The current flowing in a linear antenna forms standing waves along the length of the antenna; and for proper operation, a linear antenna is operated at, or approximately at, a resonance frequency at which the length of the linear antenna equals a quarter wavelength of the emitted electromagnetic field, or any multiple, or any odd multiple, thereof. Thus, the first section may be interconnected with a second section, and possibly further sections, of the antenna in order to obtain a combined length of the antenna appropriate for emission of the desired wavelength of the electromagnetic field. The second and possibly further sections of the antenna may form a parasitic antenna element interconnected with the first section. The parasitic antenna element may form a patch geometry, a rod geometry, a monopole geometry, a meander line geometry, etc. or any combination thereof.

In one embodiment, the combined length of the first section in a direction substantially in parallel to an ear to ear axis of the user when the housing is worn in its operational position by the user and the parasitic antenna element may be a quarter wavelength, or any multiple of, or odd multiple of, a quarter wavelength.

In an embodiment wherein the first section has a sufficient length and conducts a high current relative to the total current flowing in the antenna at and proximate a maximum of the standing wave(s) formed by the current, the first section contributes significantly to the electromagnetic field emitted from the proximity antenna. Thereby, the orientation of the parasitic antenna elements are rendered less important or unimportant since these other elements do not contribute significantly to the electromagnetic field emitted from the antenna.

Thus, the orientation of current paths of the parasitic antenna element may be determined in response to limitations imposed by the shape and small size of the hearing aid housing and desirable positioning and shape of other components in the housing. For example, second and possible further sections of the parasitic antenna element may be positioned so that current flows in the sections in directions in parallel to the surface of the head when the hearing aid housing is worn in its operational position at the ear of the user. The parasitic antenna element preferably has a free end opposite the parasitic antenna element excitation point.

The hearing aid may comprise further parasitic antenna elements in order to obtain a desired directional pattern of the emitted electromagnetic field and possibly a desired polarization.

Thus, the antenna formed by the first section and the one or more parasitic antenna elements may be structured so that current flows in the first section in a direction that is parallel to the ear to ear axis of the user during use, and so that the combined length of the antenna elements has the desired length for effective emission of the desired electromagnetic field. The desired length may preferably be a quarter wavelength of the electromagnetic radiation or any multiple, or any odd multiple, thereof. However, it is envisaged that the path of current flowing in the antenna exhibits a number of bends due to the different orientations of the sections provided in such a way that the antenna fits inside the hearing aid housing while simultaneously being configured for emission of the desired radiation pattern and polarization at the desired radio frequency.

The overall physical length of the antenna may be decreased by interconnecting the antenna with an electronic component, a so-called antenna shortening component, having an impedance that modifies the standing wave pattern of the antenna thereby changing its effective length. The required physical length of the antenna may for example be shortened by connecting the antenna in series with an inductor or in shunt with a capacitor.

Thus, the antenna may have a single linear section of a relative short length positioned in the hearing aid housing in such a way that its longitudinal direction is parallel to an ear to ear axis of the user when the hearing aid housing is worn in its operational position at the ear of the user. Furthermore, the single linear section, such as the first section, may be connected in series with an antenna shortening component, e.g. a serial inductor.

The hearing aid may further comprise a primary antenna element for communicating with a remote control or other accessories, such as a telephone, a television, a television box, a television streamer box, a spouse microphone, a hearing aid fitting system, etc. The primary antenna element is typically positioned to facilitate communication with equipment positioned at a distance from the user, and is thus typically provided on or inside the housing so as to emit electromagnetic radiation to and receive electromagnetic radiation from hearing aid accessories.

The first section of the antenna may have an excitation point, so that the first section may be fed from an electronic circuit in the hearing aid, that is be actively excited, or alternatively, the first section may be passively excited. The first section and the primary antenna element may have a common excitation/feeding point. Typically, the excitation point of an antenna element is a point connected to a ground potential, such as a zero potential or a relative ground potential. The primary antenna may be fed at a longitudinal side of the ground plane, such as at the longitudinal side of a rectangular ground plane, which in turn may cause the current to run primarily along the shortest dimension of the ground plane, normal to the side of the head, or normal to the body part to which the antenna system is attached.

The hearing aid antenna, or the antenna system configured to be worn on a body of a user, may comprise a plurality of antenna elements, such as the primary antenna element, the first section and/or one or more parasitic antenna elements. The antenna elements may form separate structural elements which interact during operation of the hearing aid or any other device interacting with the antenna system.

For example behind-the-ear hearing aid housings typically accommodate primary antenna elements positioned with their longitudinal direction in parallel to the longitudinal direction of the banana shaped behind-the-ear hearing aid housing on one side of the hearing aid, while in-the-ear hearing aids have typically been provided with patch antennas positioned on the face plate of the hearing aids.

In some embodiments, the primary antenna element is provided on a first side of the hearing aid assembly, and at least a part of the parasitic antenna element, may be provided on a second side of the hearing aid assembly. The first side and the second side of the hearing aid assembly may be substantially parallel, and the primary antenna element and the parasitic antenna element may be positioned at opposite sides of the hearing aid assembly. The primary antenna element and the parasitic antenna element may be connected by a supporting element, such as a supporting element forming a ground plane, such as a ground potential plane, for the primary antenna element and/or the parasitic antenna element, such as a supporting element comprising the first section. The supporting element may be a conducting element.

In one embodiment, the primary antenna element may excite at least a part of the first section and thereby also excite the parasitic antenna element. Hereby, even if the first section does not comprise an antenna, but constitute a ground plane for the parasitic antenna element and the primary antenna element, a current will be induced in the first section. Thus, the first section may form a ground plane wherein a current induced in the first section upon excitation of the primary antenna element may flow. The ground plane thus guides the current induced by the primary antenna element. In a preferred embodiment, the excitation point for the parasitic antenna is opposite to an excitation point for the primary antenna element.

In a preferred embodiment, the primary antenna element excitation point and the parasitic antenna element excitation point are provided separated by a distance along an axis substantially orthogonal to the body of a user, such as substantially parallel to the ear-to-ear axis of a user, the distance preferably being between one sixteenth wavelength and a full wavelength, such as between one sixteenth and three quarters wavelength, such as between one sixteenth and five eights wavelength, such as between one sixteenth and a half wavelength, such as between one sixteenth and three eights wavelength, such as between one sixteenth and one eights wavelength. It is envisaged that for some embodiments, it may be advantageous to use a lower limit on the length being one eight wavelength. In a specifically preferred embodiment, the length of the first section is between one sixteenth wavelength and one eighth wavelength. The optimum length is selected based on a number of criteria including any size restraints and strength of the electromagnetic field.

Upon excitation, the induced current will flow in the first section from the primary antenna element excitation point to the parasitic antenna element excitation point in the direction parallel to the ear-to-ear axis of a user, and the current will excite the parasitic antenna element.

Preferably, the primary antenna element excitation point and the parasitic antenna element excitation point are provided at the ground plane for the antenna elements so that upon excitation of the primary antenna element current flows in the at least first section in a direction which is substantially orthogonal to the head when the hearing aid is worn by a user in its operational position. It is envisaged that the primary antenna element excitation point and the parasitic antenna element excitation point also may be provided along an axis forming an angle to the ear-to-ear axis. In a preferred embodiment, the ground plane may be a printed circuit board connecting the primary antenna element and the parasitic antenna element(s). In this case both the primary antenna element excitation point and the parasitic antenna element excitation point are provided at the printed circuit board. The ground potential plane may thus be a printed circuit board, but the ground potential plane may be formed in any material capable of conducting a current upon excitation of the antenna elements. The ground plane may also be formed as a single conducting path of e.g. copper, for guiding the current.

The length of the at least first section is defined as the length of the current path from the primary antenna element excitation point to the parasitic antenna element excitation point.

It is an advantage of providing the parasitic element that the bandwidth for the antenna system is increased significantly, compared to an antenna system where no parasitic antenna element is provided, the bandwidth may be improved by a factor two, such that the bandwidth is doubled, compared to an antenna system having only the primary antenna and the first section. In a preferred embodiment, the parasitic antenna element is a mirror picture of the primary antenna element, or the parasitic antenna element and the primary antenna element may form symmetric antenna structures, e.g. so that the primary antenna element forms a meandering antenna structure and the parasitic antenna element forms a corresponding meandering antenna structure, the parasitic and the primary antenna element may also form identical antenna structures.

The specific positioning of the primary antenna element and the first section and one or more parasitic antenna elements may be determined by the shape of the hearing aid.

For example behind-the-ear hearing aid housings typically accommodate primary antenna elements positioned with their longitudinal direction in parallel to the longitudinal direction of the banana shaped behind-the-ear hearing aid housing on one side of the hearing aid, while in-the-ear hearing aids typically have been provided with patch antennas positioned on the face plate of the hearing aids.

In some embodiments, the housing is a behind-the-ear housing configured to be positioned behind the ear of the user during use and the primary antenna element is provided on a first longitudinal side of the hearing aid assembly, and the parasitic antenna element(s) are provided on a second longitudinal side of the hearing aid assembly. The primary antenna element and the parasitic antenna element may be connected via a first section, such as a first section provided on a printed circuit board, such as a supporting element comprising an antenna, etc., or the first section may constitute a ground plane for the antenna elements.

The hearing aid antenna comprising the parasitic antenna element, the first section and the primary antenna element may be configured for operation in the ISM frequency band. Preferably, the antennas are configured for operation at a frequency of at least 1 GHz, such as at a frequency between 1.5 GHz and 3 GHz such as at a frequency of 2.4 GHz.

A hearing aid includes: a hearing aid assembly having an antenna for emission of an electromagnetic field, a transceiver for wireless data communication, the transceiver interconnected with the antenna, and a housing for accommodation of the antenna; wherein the antenna comprises a first section having a length between at least one sixteenth wavelength and a full wavelength of the electromagnetic field, the antenna being positioned so that current flows in the first section in a direction that corresponds with an ear-to-ear axis of a user when the housing is worn in its operational position by the user, whereby the electromagnetic field emitted by the antenna propagates along a surface of a head of the user with its electrical field substantially orthogonal to the surface of the head of the user.

Optionally, the first section forms part of the antenna having a total length of a quarter wavelength or any multiple thereof.

Optionally, the first section of the antenna is actively excited.

Optionally, the antenna is a passively excited antenna.

Optionally, the antenna further comprises a parasitic antenna element, the parasitic antenna element comprising a patch geometry, a rod geometry, a monopole geometry, a meander line geometry, or any combination thereof.

Optionally, the hearing aid further comprises a primary antenna element.

Optionally, the primary antenna element and the parasitic antenna element are positioned on opposite sides of the hearing aid assembly.

Optionally, the first section forms a ground potential plane for the primary antenna and the parasitic antenna element.

Optionally, an excitation point for the parasitic antenna element is opposite to an excitation point for the primary antenna element.

Optionally, the primary antenna element and the parasitic antenna element are identical antenna structures.

Optionally, the first section is a first linear section that is positioned with a longitudinal direction substantially in parallel with an ear-to-ear axis of the user when the housing is worn in its operational position by the user.

Optionally, the current of the antenna has its maximum amplitude in the first section during emission of the electromagnetic field.

Optionally, the antenna further comprises a parasitic antenna element, and the parasitic antenna element comprises an antenna shortening component.

Optionally, the antenna shortening component comprises a serial inductor.

Optionally, the housing is a behind-the-ear housing configured to be positioned behind an ear of the user during use.

Optionally, the first section is accommodated in the housing with its longitudinal direction along a width of the housing.

Optionally, the antenna is configured for electromagnetic field emission.

A binaural hearing aid system includes at least one hearing aid according to any of the embodiments described herein.

An antenna system configured to be worn on a body of a user, includes: an antenna for emission of an electromagnetic field; and a transceiver for wireless data communication, the transceiver interconnected with the antenna; wherein the antenna comprises a first section having a length being between at least one sixteenth wavelength and a full wavelength of the electromagnetic field, the antenna being positioned so that current flows in the first section in a direction substantially orthogonal to the body of a user when the antenna system is worn in its operational position by the user, whereby the electromagnetic field emitted by the antenna propagates along a surface of the body of the user with its electrical field substantially orthogonal to the surface of the body of the user.

Other and further aspects and features will be evident from reading the following detailed description of the embodiments.

BRIEF DESCRIPTION OF THE DRAWINGS

The above and other features and advantages will become more apparent to those of ordinary skill in the art by describing in detail exemplary embodiments thereof with reference to the attached drawings in which.

DETAILED DESCRIPTION

Figure 1:
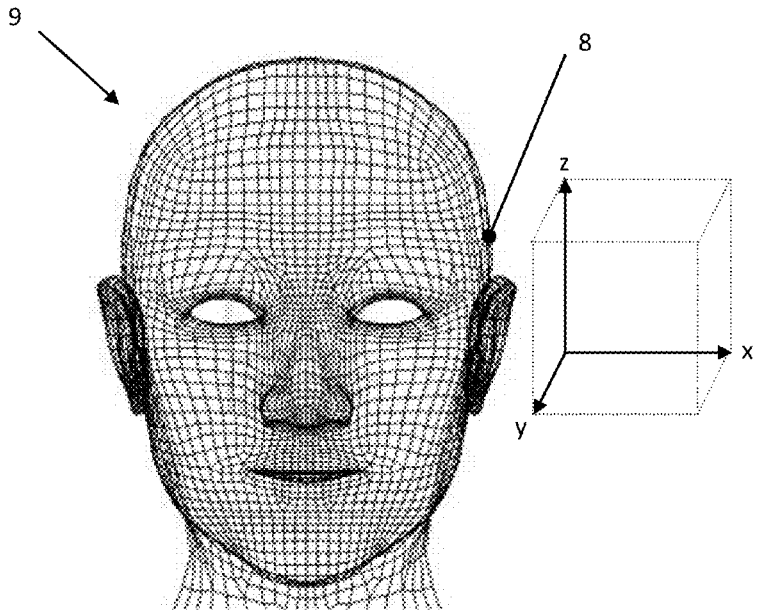
FIG. 1 is a phantom head model of a user together with an ordinary rectangular three dimensional coordinate system with an x, y and z axis for defining the geometrical anatomy of the head of the user.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated. Also, reference throughout this specification to "some embodiments" or "other embodiments" means that a particular feature, structure, material, or characteristic described in connection with the embodiments is included in at least one embodiment. Thus, the appearances of the phrase "in some embodiments" or "in other embodiments" in various places throughout this specification are not necessarily referring to the same embodiment or embodiments.

In the following, a parallel antenna or a parallel section of an antenna designates an antenna or a section of an antenna, respectively, in a device that is worn at the ear of a user during use and that conducts current solely in directions parallel to the surface of the head at the ear of the user, or in other words perpendicular to the ear to ear axis of the user, and an orthogonal antenna or an orthogonal section of an antenna designates an antenna or a section of an antenna, respectively, in a device that is worn at the ear of a user during use and that, at least in a section of the antenna, conducts current in a direction that is orthogonal to the surface of the head at the ear of the user, or in other words parallel to the ear to ear axis of the user.

The radiation pattern of an antenna is typically illustrated by polar plots of radiated power in horizontal and vertical planes in the far field of the antenna. The plotted variable may be the field strength, the power per unit solid angle, or directive gain. The peak radiation occurs in the direction of maximum gain.

When designing antennas for wireless communication proximate the human body, the human head can be approximated by a rounded enclosure with sensory organs, such as the nose, ears, mouth and eyes attached thereto. Such a rounded enclosure 9 is illustrated in FIG. 1. In FIG. 1, the phantom head model is shown together with an ordinary rectangular three dimensional coordinate system with an x, y and z axis for defining orientations with relation to the head.

Every point of the surface of the head has a normal and tangential vector. The normal vector is orthogonal to the surface of the head while the tangential vector is parallel to the surface of the head. An element extending along the surface of the head is said to be parallel to the surface of the head while an object extending from a point on the surface of the head and radially outward from the head into the surrounding space is said to be orthogonal to the head.

As an example, the point with reference numeral 8 in FIG. 1 furthest to the left on the surface of the head in FIG. 1 has tangential vectors parallel to the yz-plane of the coordinate system, and a normal vector parallel to the x-axis. Thus the y-axis and z-axis are parallel to the surface of the head at the point 9 and the x-axis is orthogonal to the surface of the head at the point 9.

The user modelled with the phantom head of FIG. 1 is standing erect on the ground (not shown in the figure), and the ground plane is parallel to xy-plane. The torso axis from top to toe of the user is thus parallel to the z-axis, whereas the nose of the user is pointing out of the paper along the y-axis.

The axis going through the right ear canal and the left ear canal is parallel to the x-axis in the figure. This ear to ear axis (ear axis) is thus orthogonal to the surface of the head at the points where it leaves the surface of the head. The ear-to-ear axis as well as the surface of the head will in the following be used as reference when describing specific configurations of the elements in one or more embodiments.

Since the auricle of the ear is primarily located in the plane parallel to the surface of the head on most test persons, it is often described that the ear to ear axis also functions as the normal to the ear. Even though there will be variations from person to person as to how the plane of the auricle is oriented.

The in the ear canal type of hearing aid will have an elongated housing shaped to fit in the ear canal. The longitudinal axis of this type of hearing aid is then parallel to the ear axis. The behind the ear type of hearing aid will typically also have an elongated housing most often shaped as a banana to rest on top of the auricle of the ear. The housing of this type of hearing aid will thus have a longitudinal axis parallel to the surface of the head of the user.

With reference to FIG. 1, the length of a behind the ear apparatus will primarily be measured along the y-axis whereas the width will be measured along the x-axis and the height be measured along the z-axis.

Figure 1A:
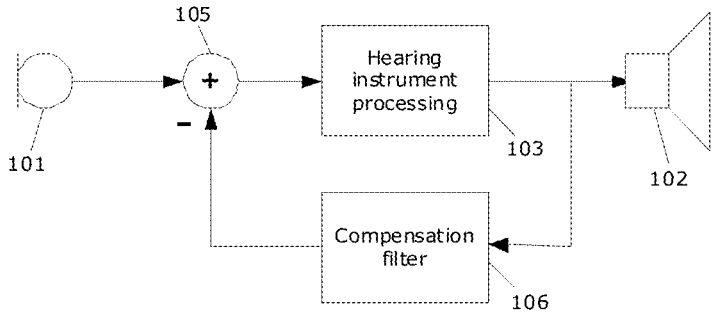
FIG. 1*a* shows a block-diagram of a typical hearing aid.

A block-diagram of a typical (prior-art) hearing instrument is shown in FIG. 1*a*. The hearing aid comprises a microphone 101 for receiving incoming sound and converting it into an audio signal. A receiver 102 converts output from the hearing instrument processor 103 into output sound, e.g. modified to compensate for a users hearing impairment. Thus, the hearing instrument processor 103 may comprise elements such as amplifiers, compressors and noise reduction systems etc. For proper operation, a rod-shaped antenna typically has a length approximately equal to a quarter of the wavelength of the emitted electromagnetic field at the desired radio frequency. Conventionally, orthogonal rod-shaped antennas have been too long to be accommodated inside a hearing aid housing with no parts protruding from the housing.

Figure 2A:
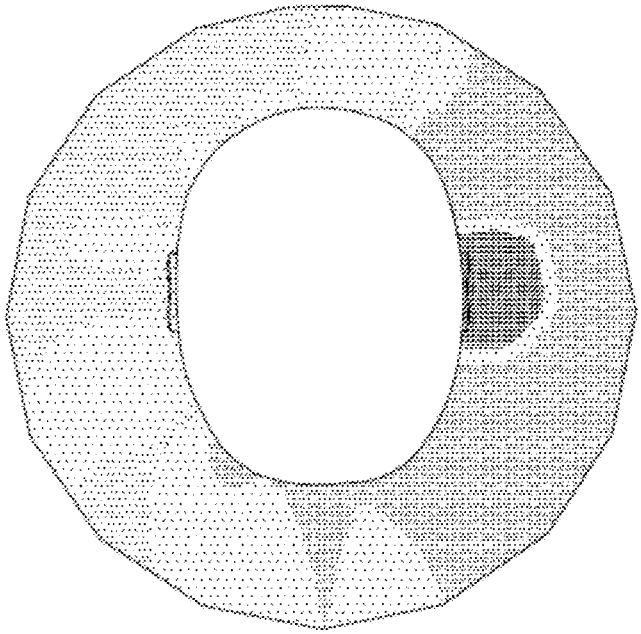
Fig. 2a. (prior art)
FIG. 2*a* is a plot of the strength of the electric field (E) around the head for a parallel antenna configuration seen from above the head (prior art)
Figure 2B:
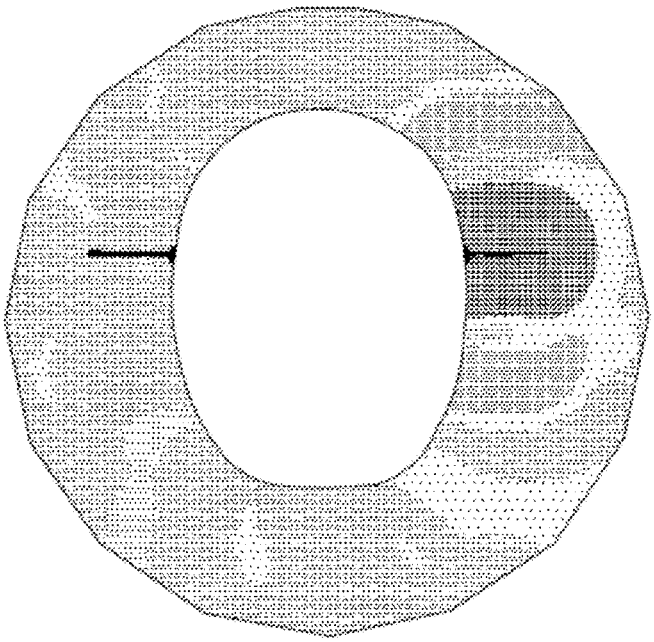
FIG. 2*b* is a plot of the strength of the electric field (E) around the head for an orthogonal antenna configuration seen from above the head.

FIGS. 2*a* and 2*b* illustrate the power of an electromagnetic field radiated around the head of a human, when the electromagnetic field is emitted by an antenna positioned at one of the ears of the human. The electromagnetic field is viewed from above the head of the human. The power values are illustrated in grey-levels, high power is black and low power is white.

In FIG. 2*a*, the electromagnetic field is emitted by a parallel rod antenna. The antenna is shown to the left in FIG. 2*a* in white as a white rod. FIG. 2*a* shows how the parallel antennas of the prior art performs. The plot shows the strength of the electric field around the head. The field strength in the plot is indicated by the tone of the grey-level: The stronger the field the darker the grey level. For example, the plot around the radiating antenna is black. Thus, the field strength around the antenna is high. The grey-levels get paler and paler with increased distance to the antenna. The field strength at the receiving antenna at the opposite side of the head is very low and the plot around the receiving antenna is almost white. Thus, in order to obtain reliable wireless communication with parallel antennas in devices worn at the two ears of a human, the devices have to comprise a powerful amplifier for amplification of the received signal; and/or a powerful amplifier for transmission of a high power electromagnetic signal. In a hearing aid, this is not desirable, since batteries supplying power for hearing aid circuitry are small and have limited power capacity.

In FIG. 2*b*, the electromagnetic field is emitted by an orthogonal rod antenna. Again, the antenna is shown to the left in FIG. 2*b* in the form of a white rod.

The strength of the electric field is plotted around the head in the same way as in FIG. 2*a*. It should be noted that the strength of the electromagnetic field at the opposite side of the head at the receiving antenna is larger than in FIG. 2*a*, and therefore reliable wireless communication between orthogonal antennas in devices worn at the two ears of a human can be established without the requirement of powerful amplifiers.

The improvement is believed to be caused by the fact that a parallel rod antenna emits an electromagnetic field primarily in a direction perpendicular to the surface of the head at the position of the antenna, and the electrical field of the electromagnetic field is parallel to the surface of the head giving rise to resistive transmission loss in the tissue of the head.

Contrary to this, an orthogonal rod antenna emits an electromagnetic field primarily in a direction parallel to the surface of the head facilitating transmission of the electromagnetic field around the head, and the electrical field of the electromagnetic field is perpendicular to the surface of the head whereby transmission loss in the tissue of the head is reduced.

The limited space available in a hearing aid housing makes it difficult to accommodate an orthogonal rod-shaped antenna in a hearing aid housing; however it has been shown that the rod-shaped antenna may have one or more bends without deteriorating its performance significantly, provided that the part of the rod-shaped antenna that contributes significantly to the part of the emitted electromagnetic field received at the opposite ear maintains its orthogonal orientation.

During operation, the rod-shaped antenna conducts a current of a standing wave. The free end of the rod-shaped antenna constitutes a node of the standing wave in which the current is zero. Thus, the part of the rod-shaped antenna proximate its free end does not contribute with a significant part of the magnetic field of the emitted electromagnetic signal. At the root of the rod-shaped antenna that is connected to the transceiver circuitry of the hearing aid and supplied with current, the current has maximum amplitude, and therefore the part of the rod-shaped antenna proximate the root of the antenna, or the feed point or excitation point of the antenna, contribute with a significant part of the magnetic field of the emitted electromagnetic field.

Figure 3:
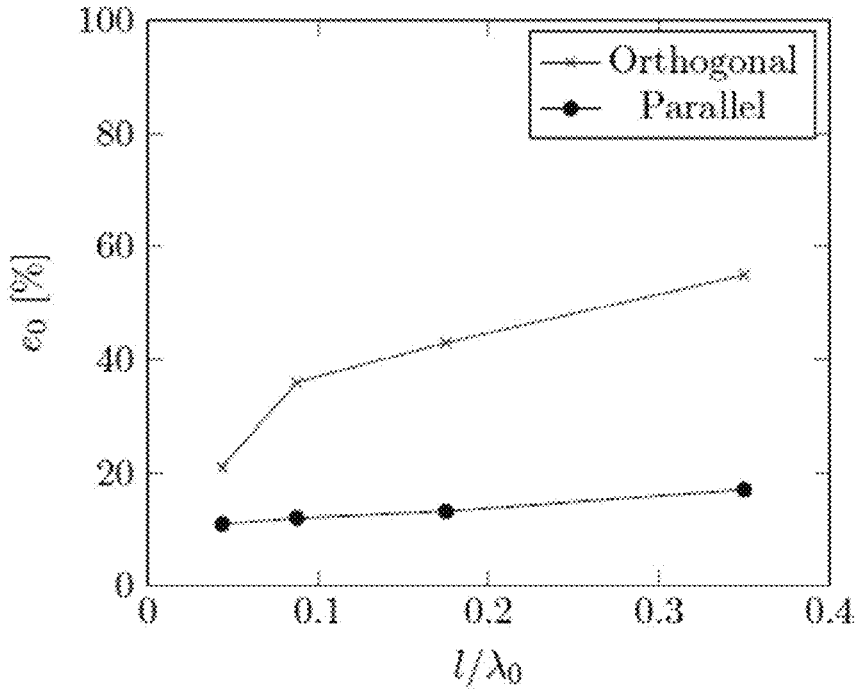
FIG. 3 shows the total efficiency of a parallel as well as an orthogonal antenna configuration as a function of antenna length.

Thus, preferably, a part of the antenna proximate the root of the antenna, or the excitation point of the antenna, constitutes the first section of the antenna having a longitudinal direction that is orthogonal to the surface of the head of the user, when positioned in its desired operational position at the ear of the user. The orientation of the remaining part of the antenna is not critical in order to obtain the desired power of the electromagnetic field at the opposite ear of the user, but further section(s) is/are required in order for the antenna to have the required length for proper operation at the desired radio frequency, e.g. equal to, or approximately equal to, a quarter wavelength of the field or any multiple thereof In FIG. 3, total efficiencies of a parallel monopole rod antenna and an orthogonal monopole rod antenna with relation to path loss around the head of a human are compared as a function of physical antenna length. The resonance frequency of the antennas is kept the same by using a serial inductance. It should be noted that even the shortest orthogonal antenna is more effective in establishing an electromagnetic field at the opposite side of the head than the longest parallel antenna.

Figure 4:
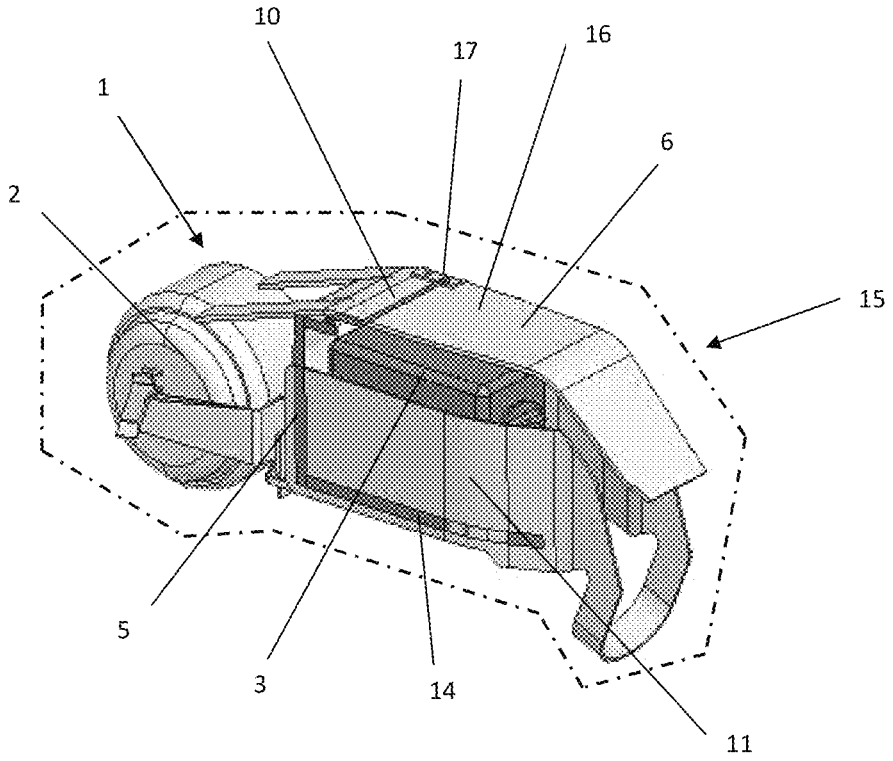
FIG. 4 is a view from the side of various parts of an exemplary BTE hearing aid with an orthogonal antenna.

FIG. 4 shows an assembly of various parts 1 of a BTE hearing aid with an antenna 10, 5 having a first section 10 that is positioned with a longitudinal direction substantially in parallel to an ear to ear axis of the user when the housing is worn in its desired operational position by the user. The first linear section 10 is located at the top side 16 of the hearing aid assembly, and it extends along the entire width of the top side 16 of the assembly 1. The first linear section 10 is fed with current from the printed circuit board 6. The antenna further has a second linear section 5 with a longitudinal direction substantially perpendicular to the longitudinal direction of the first linear section 10 and substantially parallel to the side of the BTE hearing aid assembly 1. The antenna ends in a third linear section that has a longitudinal direction that is substantially perpendicular to both the first section 10 and the second linear section 5 and substantially parallel to the side 11 of assembly and thus to the BTE hearing aid housing. The BTE hearing aid housing 15 accommodating the hearing aid assembly 1 in its entirety is illustrated in FIG. 4 with a dashed line.

The first, second, and third linear sections 10, 5, 14 of the antenna are electrically interconnected and the interconnected first, second and third linear sections form the antenna of the required length. The second and third sections form a parasitic antenna element. The connection between the first and second linear sections 10, 5 is typically located where the top 16 of the hearing aid assembly 1 and the side 11 of the assembly intersect. When current flows through the excitation point 17 into the first linear section 10, it will continue into the second linear section 5 while experiencing a bend where the two sections are connected.

The second linear section 5 and the third linear section 14 extend along the right or left side 11, 12 of the hearing aid assembly and thus also extend along the right or left side of the inside of the hearing aid housing 15, and the antenna is terminated with a free end with no electrical connection to other parts. A current in the antenna will thus have a zero or node at the free end, and the antenna current has its largest magnitude at the excitation point.

The illustrated assembly of parts 1 are accommodated in a hearing aid housing 15 (dashed line). In the illustrated BTE hearing aid, the battery 2 is housed in the rear of the hearing aid housing, and the transceiver 3 is housed centrally in the hearing aid assembly 1. The battery 2 provides power to the hearing aid circuitry and components including the transceiver 3 for generating sound for emission towards the tympanic membrane of the user and for wireless data communication and being interconnected with at least a primary antenna element. The transceiver 3 may be also be provided as two separate transceivers for generating sound and for wireless data communication, respectively. The signal processor (not shown) of the hearing aid is located on the printed circuit board 6.

When the hearing aid is worn in its operational position at the ear of the user, the orthogonal angles between the first, second and third linear sections 10, 5, 14 of the antenna provide radiation of an electromagnetic field in parallel to the surface of the head of the user and with an electrical field that is orthogonal to the surface of the head.

In another exemplary BTE hearing aid with an orthogonal antenna, the orthogonal antenna has a single linear section that is relatively short. The single linear section is positioned in the hearing aid housing so that its longitudinal direction is orthogonal to, or substantially orthogonal to, the surface of the head of the user when the hearing aid is positioned in its operational position at the ear of the user. Furthermore, the single linear section is connected in series with an antenna shortening component, e.g. a serial inductor, or a parasitic antenna element.

However, also other embodiments of the antenna and the antenna configurations may be contemplated.

Preferably, the primary antenna element is an antenna element configured also for communication with external devices, such as a remote control, a mobile phone, a TV, etc.

In general, various sections of the antenna can be formed with many different geometries, they can be wires or patches, bend or straight, long or short as long as they obey the above relative configuration with respect to each other such that at least one conducting part will carry a current being primarily parallel to the ear axis (orthogonal to the surface of the head 9 of the user at a point 8 in proximity to the ear) such that the field will be radiated in the desired direction and with the desired polarization such that substantially no attenuation is experienced by the surface wave travelling around the head. Preferably, the at least one conducting part is provided in proximity to the excitation point.

The specific wavelength, and thus the frequency of the emitted electromagnetic field, is of importance when considering communication involving an obstacle. In some embodiments, the obstacle is a head with a hearing aid comprising an antenna located closed to the surface of the head. If the wavelength is too long such as a frequency of 1 GHz and down to lower frequencies greater parts of the head will be located in the near field region. This results in a different diffraction making it more difficult for the electromagnetic field to travel around the head. If on the other hand the wavelength is too short, the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

Figure 5A:
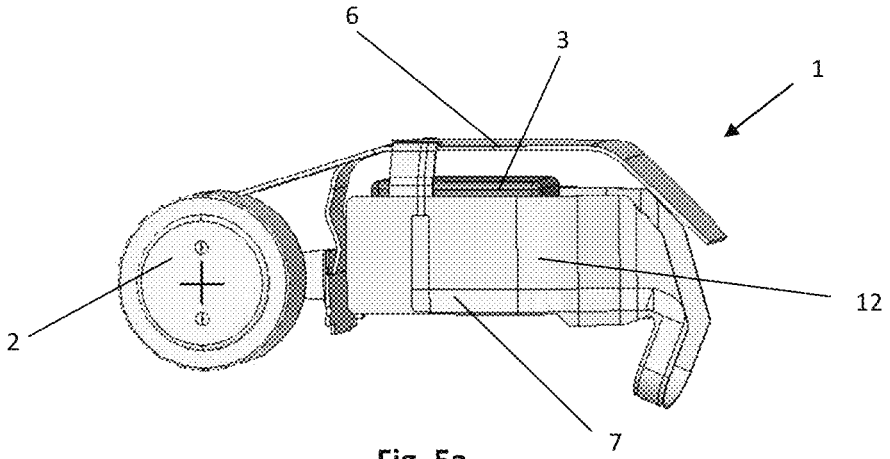
FIG. 5*a* is a view from the left hand side of various parts of another exemplary BTE hearing aid with an orthogonal antenna.
Figure 5B:
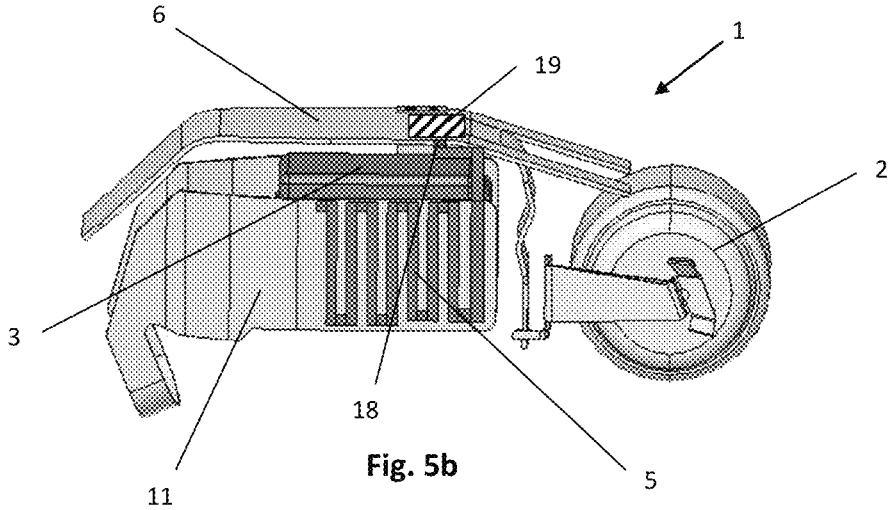
FIG. 5*b* is a view from the right hand side of the parts shown in FIG. 5*a*.

FIGS. 5*a* and 5*b* show opposite sides of a hearing aid assembly of various parts 1 of another BTE hearing aid with another exemplary orthogonal antenna.

The illustrated hearing aid assembly of the BTE hearing aid include a battery 2, a transceiver 3, a printed circuit board 6, internal wall parts, or first and second sides of the hearing aid assembly 11, 12 and a primary antenna element 7. It is seen that the primary antenna element is configured as a parallel antenna. The signal processor (not shown) is located on the printed circuit board 6.

In FIG. 5*a*, the primary antenna element 7 is located at the first or right side 12 of the hearing aid housing. However, the primary antenna element 7 may be located at a second or the left side of the housing, at the top side of the housing, at the front side of the housing, at the back side of the housing or at the bottom side of the housing. The allowable length of the primary antenna element 7 is constrained by the length of the side of the housing at which it is located. The longer the side, the longer the part can be. In general, the length of the primary antenna element is dictated by the operating frequency, the group velocity of the current flowing on the antenna and the number of nulls that is desired. Normally, the velocity is approximated by the velocity of light in free space. An antenna with a length of a quarter of a wave will have a current with its maximum magnitude at the excitation point and a null at the end of the antenna.

The primary antenna element 7 may act as a passive element where it shields the hearing aid electronics from interference or act as part of an antenna configured for a specific radiation pattern. In the embodiment shown in FIGS. 5*a-b*, the primary antenna element 7 is an active element being excited from an excitation point 17 on the printed circuit board and radiates an electromagnetic field into the surrounding space. Dependent on which side of the housing the primary antenna element is located on, the radiated electric field will have slightly different characteristics and radiation patterns with respect to the head 9 of the user.

FIG. 5*b* is a view from the second, or in this case the left hand side, of the BTE hearing aid assembly 1 shown in FIG. 5*a* and shows a parasitic antenna element 5. The parasitic antenna element 5 is comprised of metal or similar material in order to conduct a current of electric charges. The parasitic antenna element may be located on any side of the hearing aid housing.

The primary antenna element and the parasitic antenna element are interconnected via a supporting or connecting element 6, in this case the printed circuit board 6, which forms a ground plane for the primary antenna element. In this way, upon excitation of the primary antenna element, a current generated by the electromagnetic field has its maximum in at least a first section 19 of the supporting element 6 and flows from the primary antenna element to the parasitic antenna element and excites the parasitic antenna element. The first section may comprise the entire supporting element or any part thereof.

Preferably, the excitation point 18 for the parasitic antenna element 5 is located at a distance from the excitation point 17 of the primary antenna element 7 along an axis substantially parallel to the ear to ear axis. Preferably, the excitation point 18 for the parasitic antenna element 5 and the excitation point 17 of the primary antenna element 7 are positioned on opposite sides of the hearing aid assembly 1. However, it is envisaged that at least a part of the parallel or primary antenna element 7 and/or the parasitic antenna element 5 may be provided on any side of the hearing aid, as long as the excitation points 17, 18 are provided at a distance along an axis substantially parallel to the ear to ear axis.

Furthermore, at least a part of the primary antenna element 7 and/or the parasitic antenna element may extend along the supporting element. Preferably, the first section 19 of the supporting element is between one sixteenth wavelength and a full wavelength of the emitted electromagnetic field, the length being measured along the path of maximum current between the excitation points 17,18.

In FIG. 5*b*, the parasitic antenna element 5 is located on the left side 11 of the assembly 1. The parasitic antenna element 5 can be a separate element with no connections to the other elements in the hearing aid, or it can be operatively connected to the primary antenna element 7, e.g. via the printed circuit board 6.

In FIG. 5*b*, the conducting part of the circuit board 6 interconnecting the primary antenna element 7 with the parasitic antenna element 5 constitutes the first section of the orthogonal antenna of the illustrated hearing aid due to the positioning of the interconnections at the desired longitudinal axis of the first section thereby forming the desired current path of the first section for emission of the desired part of the electromagnetic field received at the opposite ear of the user.

In the embodiment of FIG. 5*b*, the three conducting parts, i.e. the primary antenna element 7, the parasitic antenna element 5, and the printed circuit board 6, are configured relative to each other such that when the hearing aid is located on the head 9 of a user and a current flows in the conducting elements the current in the third conducting element 6 will flow in a direction parallel to the ear to ear axis for emission of an electromagnetic field as explained above. The conducting part will thus constitute the first section and be orthogonal because the hearing aid is worn at the ear during use and at this position at the head, a conducting element being parallel to the ear to ear axis will be orthogonal to the surface of the head.

The current in the part of the circuit board 6 interconnecting the primary antenna element 7 and the parasitic antenna element 5 must flow in a direction substantially parallel to the ear to ear axis so that the emitted electromagnetic field propagates substantially in parallel to the surface of the head. The electromagnetic field thus propagates along the surface of the head until it reaches the ear on the other side of the head.

Although the radiation pattern of the antenna configuration may have side lopes, most of the radiated power will propagate in parallel to the surface of the head.

The configuration of the three parts of the orthogonal antenna illustrated in FIG. 5, furthermore has the property that the overall emitted electromagnetic field is polarized in a transverse magnetic mode so that the electrical field is orthogonal to, or substantially orthogonal to, the surface of the head so that the electromagnetic field propagates without, or with low, resistive transmission loss in the tissue of the head.

Preferably, in order to obtain effective radiation, the length of the current path of the first section of the antenna, in the illustrated example located on the printed circuit board 6, that is parallel to the ear to ear axis (orthogonal to the surface of the head proximate the operational position of the hearing aid at the ear of the user) equals the length of the side of the hearing aid assembly at which it is located. This configuration may for example be achieved by placing said conducting part at the top side of the hearing aid assembly and the primary and parasitic antenna element 5 on the right and left side respectively. When the illustrated hearing aid is located in its operational position behind the ear, the third part will constitute the first section and be orthogonal and extend along the entire top side of the housing. Furthermore, to achieve a maximum current in the at least first section of the supporting element, it is preferred that the first section has a length between one sixteenth wavelength and a full wavelength of the emitted electromagnetic field.

Figure 6:
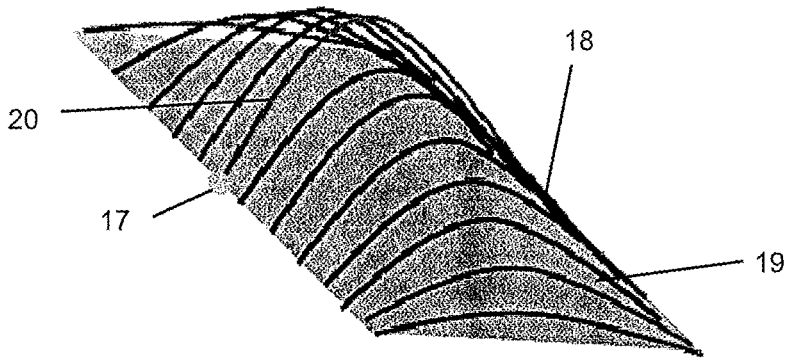
FIG. 6 is a plot of the current distribution across the at least first section of the supporting element in accordance with some embodiments.

An exemplary current distribution in the first section 19 of the first section is shown in FIG. 6. The first section is excited by the excitation point for the primary antenna element 17 and the maximum current 20 is along the shortest path to the excitation point for the parasitic antenna element 18.

In another exemplary BTE hearing aid with an orthogonal antenna, the orthogonal antenna has a single linear section that is relatively short. The single linear section is positioned in the hearing aid housing so that its longitudinal direction is orthogonal to, or substantially orthogonal to, the surface of the head of the user when the hearing aid is positioned in its operational position at the ear of the user. Furthermore, the single linear section is connected in series with an antenna shortening component, e.g. a serial inductor.

However, also other embodiments of the antenna and the antenna configurations may be contemplated.

Figure 7A:
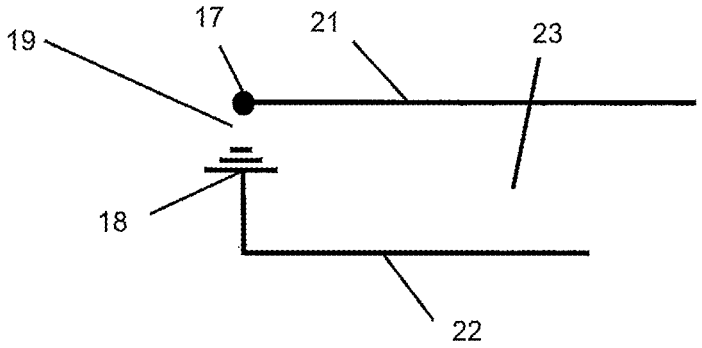
FIGS. 7*a*-7*c* show schematically exemplary implementations of the primary antenna element and the at least one parasitic antenna element.
Figure 7B:
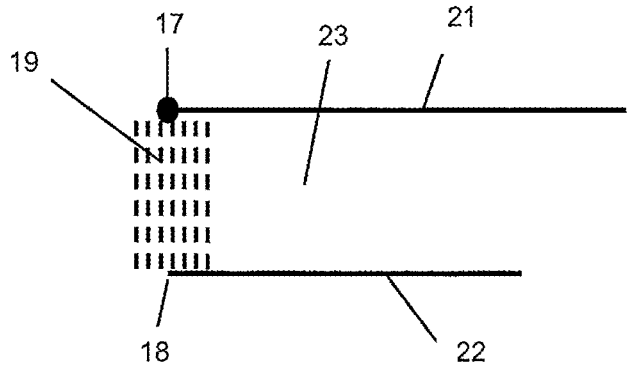
Figure 7C:
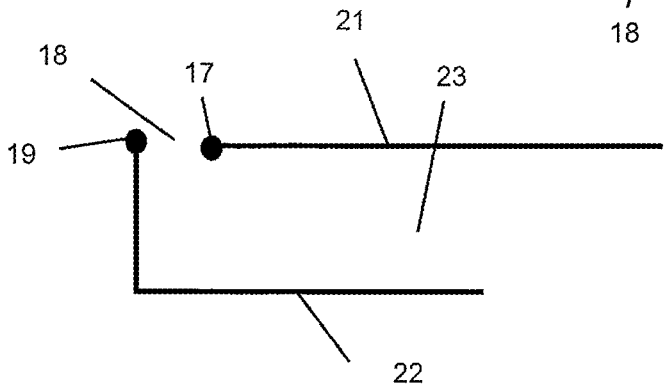

A number of possible antenna designs are shown schematically in FIGS. 7*a*-*c*. The hearing aid assembly 1 is seen from the top, and the antennas and the position of the antenna excitation points are illustrated.

FIG. 7*a* shows a primary antenna element 21 having an excitation point 17. The supporting (or connecting) element 23 forms a ground plane for the primary antenna element 21 and the excitation point 18 for the parasitic antenna element 22 is positioned a distance from the primary antenna element excitation point 17 along an axis substantially parallel to the ear to ear axis. The first section 19 of the supporting element 23 does in this example not extend over the entire width of the hearing aid.

FIG. 7*b* shows an example where the distance between the excitation points 17, 18 corresponds to the width of the hearing aid assembly. In FIG. 7*c*, an alternative embodiment is shown, wherein the excitation points 17, 18 are positioned at a distance from each other along an axis orthogonal to the ear to ear axis. In this case, the parasitic antenna element 22 is preferably connected to an antenna shortening component to ensure that a maximum current is provided in the part of the antenna orthogonal to the head.

In a preferred embodiment, the primary antenna element 21 and the parasitic antenna element 22 form identical antenna structures. For example, both the primary antenna element 21 and the parasitic antenna element 22 may form an antenna structure having a same form and same dimensions, each antenna element 21, 22 may for example form a meander line antenna having same dimensions and the same form.

It is envisaged that even though only a behind-the-ear hearing aid have been shown in the figures, the described antenna structure may be equally applied in all other types of hearing aids, including in-the-ear hearing aids, as long as the first section is configured to guide the current in a direction parallel to an ear-to-ear axis of a user, when the user is wearing the hearing aid in the operational position.

FIG. 8 shows directivity plots for a hearing aid according to some embodiments, and it is seen that the difference between positioning the hearing aid on a right hand side of a user and a left hand side of the user are minimal. The difference is caused by the mirroring of the antenna placement, so that for the left side device, the primary antenna element is placed further away from the head than for the device on the right hand side. It is thus an advantage of the hearing aid according to some embodiments may be used optionally on a right hand side and a left hand side of a user with only a minimal impact on the wireless connection both to external accessories as to the other of two hearing aids in a binaural hearing aid.

Figure 8A:
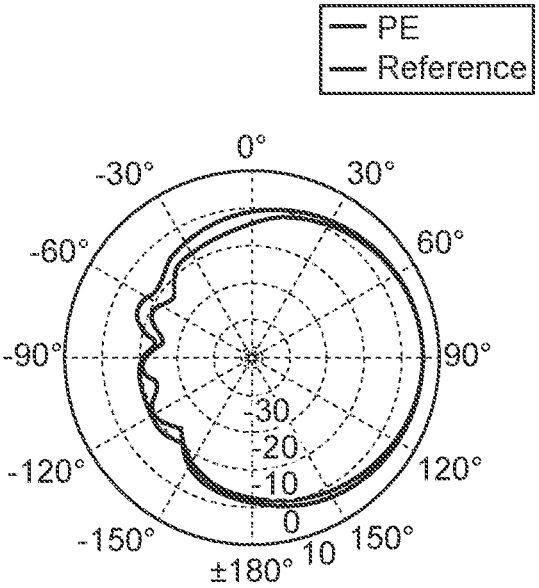
FIGS. 8*a*-8*d* are plots showing the electromagnetic field distribution around the head of a user with the hearing aid being positioned on a right hand side and a left hand side of a user, respectively.
Figure 8B:
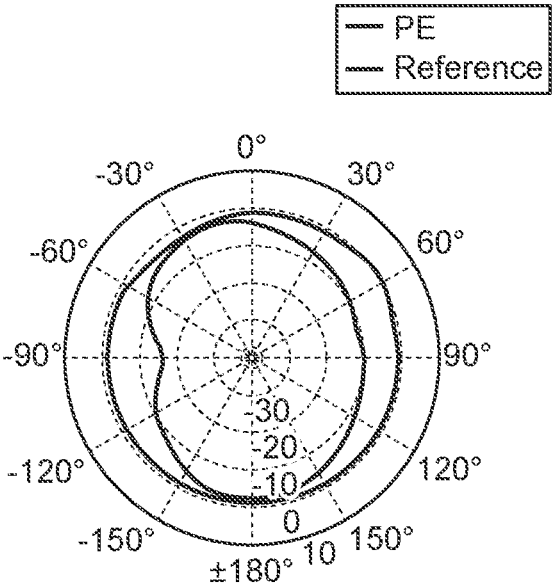

FIG. 8*a* shows the θ-cut for φ=0° total directivity, and FIG. 8*b* shows the θ-cut for φ=90° total directivity both at 2441 MHz for a hearing aid according to some embodiments, positioned on a left hand side position of a user.

Figure 8C:
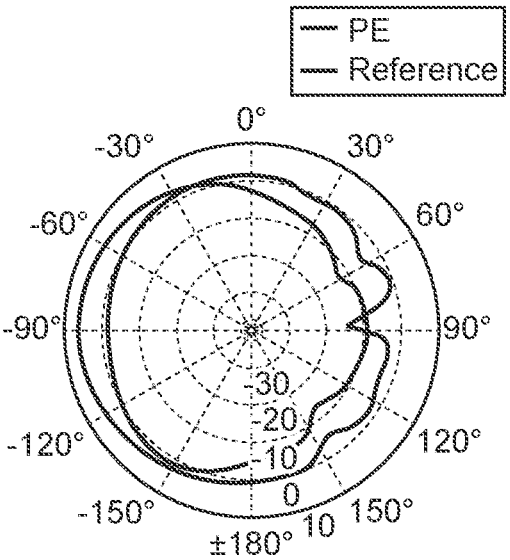
Figure 8D:
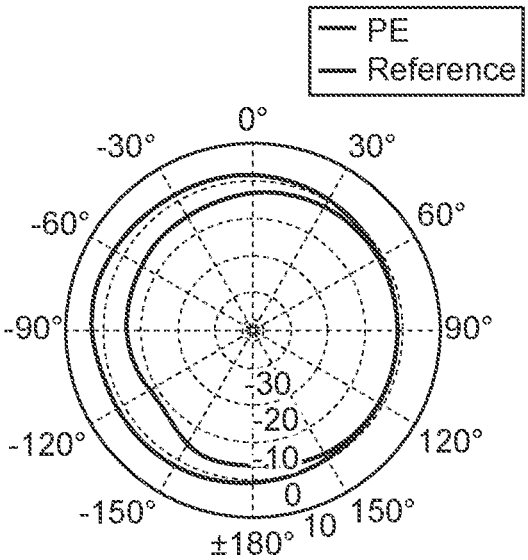

FIG. 8*c* shows the θ-cut for φ=0° total directivity, and FIG. 8*d* shows the θ-cut for φ=90° total directivity both at 2441 MHz for a hearing aid according to some embodiments, positioned on a right hand side position of a user.

In general, various sections of the antenna can be formed with many different geometries, they can be wires or patches, bend or straight, long or short as long as they obey the above relative configuration with respect to each other such that at least one conducting part will carry a current being primarily parallel to the ear axis (orthogonal to the surface of the head 9 of the user at a point 8 in proximity to the ear) such that the field will be radiated in the desired direction and with the desired polarization such that no attenuation is experienced by the surface wave travelling around the head.

The specific wavelength, and thus the frequency of the emitted electromagnetic field, is of importance when considering communication involving an obstacle. In some embodiments, the obstacle is a head with a hearing aid comprising an antenna located closed to the surface of the head. If the wavelength is too long such as a frequency of 1 GHz and down to lower frequencies greater parts of the head will be located in the near field region. This results in a different diffraction making it more difficult for the electromagnetic field to travel around the head. If on the opposite side the wavelength is too short the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

It should be noted that as used in this specification, the term "substantially" refers to a value variation that is within plus or minus 10%. For example, the term "substantially orthogonal" and similar terms refer to an angle that is 90±9 degrees. Similarly, the term "substantially parallel" and similar terms refer to angle that is 0 (or 180 degrees)±18 degrees.

Although particular embodiments have been shown and described, it will be understood that they are not intended to limit the claimed invention, and it will be obvious to those skilled in the art that various changes and modifications may be made without departing from the spirit and scope of the present inventions. The specification and drawings are, accordingly, to be regarded in an illustrative rather than restrictive sense. The claimed invention are intended to cover alternatives, modifications, and equivalents.

The invention claimed is:

1. A hearing aid, comprising:

an antenna for emission of an electromagnetic field;

a transceiver for wireless data communication, the transceiver interconnected with the antenna;

a housing for accommodation of the transceiver; and a parasitic antenna element located in the housing;

wherein the antenna comprises a first section, the antenna being positioned so that current flows in the first section in a direction that corresponds with an ear-to-ear axis of a user when the housing is worn in its operational position by the user; and wherein the first section forms a ground potential for the parasitic antenna element.

2. The hearing aid according to claim 1, wherein the first section of the antenna has a fixed orientation with respect to the housing.

3. The hearing aid according to claim 1, wherein the antenna is a passively excited antenna.

4. The hearing aid according to claim 1, wherein the antenna comprises a primary antenna element.

5. The hearing aid according to claim 4, wherein the first section forms a ground potential for the primary antenna.

6. The hearing aid according to claim 1, wherein the parasitic antenna element is a part of the antenna.

7. The hearing aid according to claim 1, wherein the antenna comprises a primary antenna element, and wherein the primary antenna element and the parasitic antenna element are positioned on opposite sides of the hearing aid.

8. The hearing aid according to claim 1, wherein the antenna comprises a primary antenna element, and wherein an excitation point for the parasitic antenna element is opposite to an excitation point for the primary antenna element.

9. The hearing aid according to claim 1, wherein the current has a maximum amplitude in the first section during emission of the electromagnetic field.

10. The hearing aid according to claim 1, wherein the antenna is an actively excited antenna.

11. The hearing aid according to claim 1, wherein the electromagnetic field has an associated electrical field that is orthogonal to a surface of a head of the user.

12. The hearing aid according to claim 1, wherein the antenna has a total length that is at least a quarter wavelength of the electromagnetic field, or longer.

13. The hearing aid according to claim 1, wherein the first section extends in a direction that forms an angle with the ear-to-ear axis of the user when the housing is worn in its operational position by the user, the angle being anywhere between −18° and 18°.

14. The hearing aid according to claim 1, wherein the electromagnetic field emitted by the antenna propagates along a surface of a head of the user.

15. The hearing aid according to claim 1, wherein the antenna comprises a monopole antenna.

16. The hearing aid according to claim 1, wherein the antenna is configured to operate at a frequency that is at least 1 GHz.

17. The hearing aid according to claim 1, wherein the antenna is configured to operate at a frequency that is between 1.5 GHz and 3 GHz.

18. The hearing aid according to claim 1, wherein the antenna is configured to operate at a frequency that is 2.4 GHz.

19. The hearing aid according to claim 1, wherein the first section extends in a longitudinal direction that is substantially parallel with the ear-to-ear axis of the user when the housing is worn in its operational position by the user.

20. The hearing aid according to claim 1, wherein the first section is accommodated in the housing with its longitudinal direction along a width of the housing.

21. The hearing aid according to claim 1, wherein the antenna comprises a second section, wherein a magnitude of the current in the first section is larger than a magnitude of a current in the second section.

22. The hearing aid according to claim 1, wherein the first section has a length between one-sixteenth wavelength and a full wavelength of the electromagnetic field.

23. A binaural hearing aid system comprising at least one hearing aid according to claim 1.

24. A hearing aid, comprising:

an antenna for emission of an electromagnetic field;

a transceiver for wireless data communication, the transceiver interconnected with the antenna;

a housing for accommodation of the transceiver; and a parasitic antenna element located in the housing;

wherein the antenna comprises a first section, the antenna being positioned so that current flows in the first section in a direction that corresponds with an ear-to-ear axis of a user when the housing is worn in its operational position by the user; and wherein the first section has a length between one-sixteenth wavelength and a full wavelength of the electromagnetic field; and wherein the first section forms a around potential for the parasitic antenna element.

25. The hearing aid according to claim 24, wherein the first section of the antenna has a fixed orientation with respect to the housing achieved during manufacturing of the hearing aid.

26. A hearing aid, comprising:

an antenna for emission of an electromagnetic field;

a transceiver for wireless data communication, the transceiver interconnected with the antenna;

a housing for accommodation of the transceiver; and a parasitic antenna element located in the housing;

wherein the antenna comprises a first section with an associated electrical field that is substantially orthogonal to a surface of a head of a user when the housing is worn in its operational position by the user;

wherein the first section of the antenna has a fixed orientation with respect to the housing during manufacturing of the hearing aid; and;

and wherein the first section forms a around potential for the parasitic antenna element.

27. The hearing aid according to claim 26, wherein the antenna is positioned so that current flows in the first section in a direction that corresponds with an ear-to-ear axis of the user when the housing is worn in its operational position by the user.

* * * * *